United States Patent [19]

Kleinert

[11] 4,432,173

[45] Feb. 21, 1984

[54] SWIMMING POOL INTEGRAL STRUCTURAL WALL BRACE SYSTEM

[75] Inventor: Werner L. Kleinert, Sterling Heights, Mich.

[73] Assignee: Carl R. Meyer; Carol S. Meyer, both of Port Isabel, Tex.

[21] Appl. No.: 352,266

[22] Filed: Feb. 25, 1982

Related U.S. Application Data

[63] Continuation of Ser. No. 131,800, Mar. 19, 1980.

[51] Int. Cl.[3] ..... E02D 27/00

[52] U.S. Cl. ..... 52/167.7; 4/506; 52/249

[58] Field of Search ..... 52/169.7, 588, 579, 52/245, 169.1, 245, 249; 4/488, 506

[56] References Cited

U.S. PATENT DOCUMENTS

| | | | |
|---|---|---|---|
| 1,076,382 | 10/1913 | Maloney . | |
| 2,123,035 | 7/1938 | Ashley . | |
| 3,015,191 | 1/1962 | Laschesi | 52/169.7 |
| 3,016,548 | 1/1962 | Lerner | 52/169.7 |
| 3,049,198 | 8/1962 | Dobbins | 52/579 |
| 3,059,243 | 10/1962 | Ross | 52/169.7 |
| 3,094,709 | 6/1963 | Miccio . | |
| 3,233,251 | 2/1966 | Barrera | 52/245 |
| 3,869,736 | 3/1975 | Valois | 52/169.7 |
| 3,969,866 | 7/1976 | Kyne | 52/588 |
| 4,124,907 | 11/1978 | Laven | 52/169.1 |

FOREIGN PATENT DOCUMENTS

| | | | |
|---|---|---|---|
| 1197310 | 11/1959 | France | 52/579 |
| 664405 | 1/1952 | United Kingdom | 52/245 |

OTHER PUBLICATIONS

Pacific Pools Brochure (Black) AG 12/79.
Pacific Pools Brochure (Blue) Copyright 1981
Fort Wayne Pools, Inc. Brochure.
Heldor Brochure.

*Primary Examiner*—Henry E. Raduazo
*Attorney, Agent, or Firm*—Bacon & Thomas

[57] ABSTRACT

The sidewall of a swimming pool is made up of bendable sheet modules fastened together at their ends. One end of each module is bent outwardly to define a vertical flange, the other end being unbent. A step is provided in the flanged end of each module of a depth to receive the unbent end of an adjacent module in coplanar relation to the unstepped area. Headed fasteners secure the modules together, their heads being housed in nested recesses in the overlapping portions of the modules to provide a smooth and continuous inner surface for the wall, the nested recesses serving to transmit forces from one module to the next without placing shear stresses on the headed fasteners.

10 Claims, 5 Drawing Figures

SWIMMING POOL INTEGRAL STRUCTURAL WALL BRACE SYSTEM

This application is a continuation of application Ser. No. 131,800, filed 3/19/80.

BACKGROUND OF THE INVENTION

This invention is in the field of swimming pool structures.

It is customary to build swimming pools by erecting a sidewall or sustaining wall around the pool within an excavation and to then provide a liner of flexible water proof sheet metal to hold the water in the pool. It has also been proposed to construct such sidewalls of modular units comprising sheets of metal or other suitable material bent to provide flanges at their ends and/or top and bottom edges to rigidify the modules. However, such modules must be constructed to the desired curved shape where curves are part of the pool design and this involves considerable manufacturing time and expense (see U.S. patents to Lucchesi U.S. Pat. No. 3,015,191, Ross U.S. Pat. No. 3,059,243 and Miccio U.S. Pat. No. 3,094,709). The above patents all include one or more upper or lower flanges to define modules of more or less pan shape, which are bolted together. However, such construction involves the manufacture of different size and shaped pans for different shaped pools. It has also been proposed to construct storage tanks of modular plates having reinforcing flanges at the edges of certain of the plates with some of the area of each module stepped outwardly, so that the adjacent module edge would seat within the step and provide a somewhat smooth surface (see U.S. Pat. No. 1,076,382). Such structure is also shown in U.S. Pat. No. 2,123,035. It has also been proposed to construct containers of modular units wherein the overlapping edges of adjacent units are provided with nested depressions to receive fasteners.

All of the previous proposals, however, were for special purposes and designed solely for that particular purpose and not clearly adaptable to swimming pools.

SUMMARY OF THE INVENTION

The present invention relates to a modularly constructed swimming pool where all modules are identical in construction and any of which may be readily bent to conform to the desired pool outline.

The modules are constructed and arranged in such a way that a smooth inner surface is provided on the pool sidewall, without any internal projections to interfere with the support of a plastic or other flexible liner material. The modules are so constructed that an interlocking relationship is provided to insure force transfer between adjacent modules without applying significant strain to the fastening members between modules. The construction of the modules is such that they are readily nestable for shipping and/or storage prior to assembly, thus reducing shipping and storage costs quite materially.

A swimming pool constructed according to the present invention may include a horizontal apron extending outwardly from the upper edge of the sidewalls of the pool which apron may be formed of poured concrete and the modules provide means for supporting the concrete adjacent the pool and for positioning reinforcing rods.

To achieve the foregoing advantages, the modules are of normally flat sheet metal having a right angle flange at one end, which will extend outwardly and vertically when the pool wall is erected, the other end of each module being unbent. Each of the modules adjacent the flange is stepped outwardly to a depth sufficient to receive the adjacent edge of an adjacent module and thus provide a smooth inner surface for the pool wall. The overlapping areas of adjacent modules are provided with nested depressions which serve to transmit forces from one module to the other, and also serve to bring the adjacent modules into proper alignment for assembly. Each of the depressions is provided with an opening through which a headed fastener, such as a bolt and nut pair, may be positioned to lock the modules together. The heads fo the fasteners are housed within the inner recess and thus do not constitute projections projecting into the pool to interfere with proper seating of the flexible liner.

DESCRIPTION OF A PREFERRED EMBODIMENT

Figure 1:
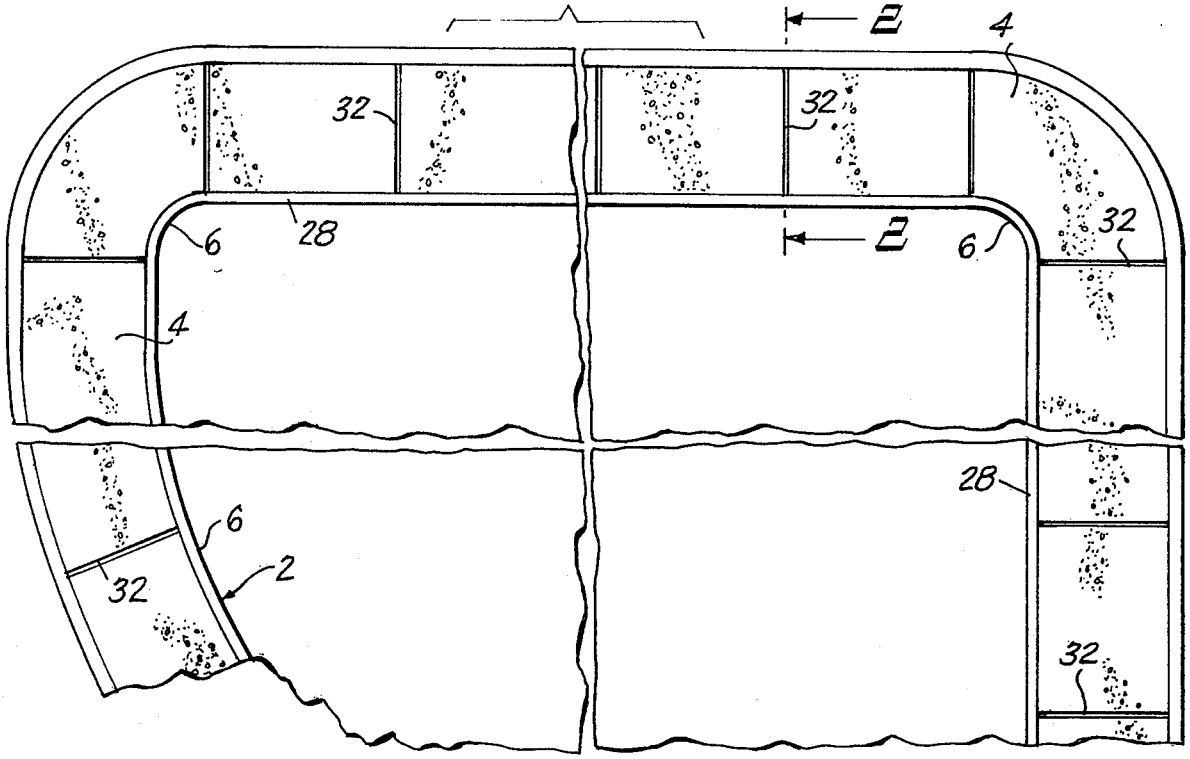
FIG. 1 is a fragmentary plan view of a portion of a swimming pool constructed according to the present invention.

In FIG. 1 of the drawings, numeral 2 designates generally the sidewall of a swimming pool and numeral 4 designates a concrete apron extending outwardly from the upper edge of the pool. As shown in FIG. 1, one of the sidewalls and an end wall of the pool are substantially straight and planar, whereas the corners and one sidewall are in the form of arcuate curves 6. The shape shown, however, is not critical or necessary, the pool may be of any desired free form or oval.

Figure 2:
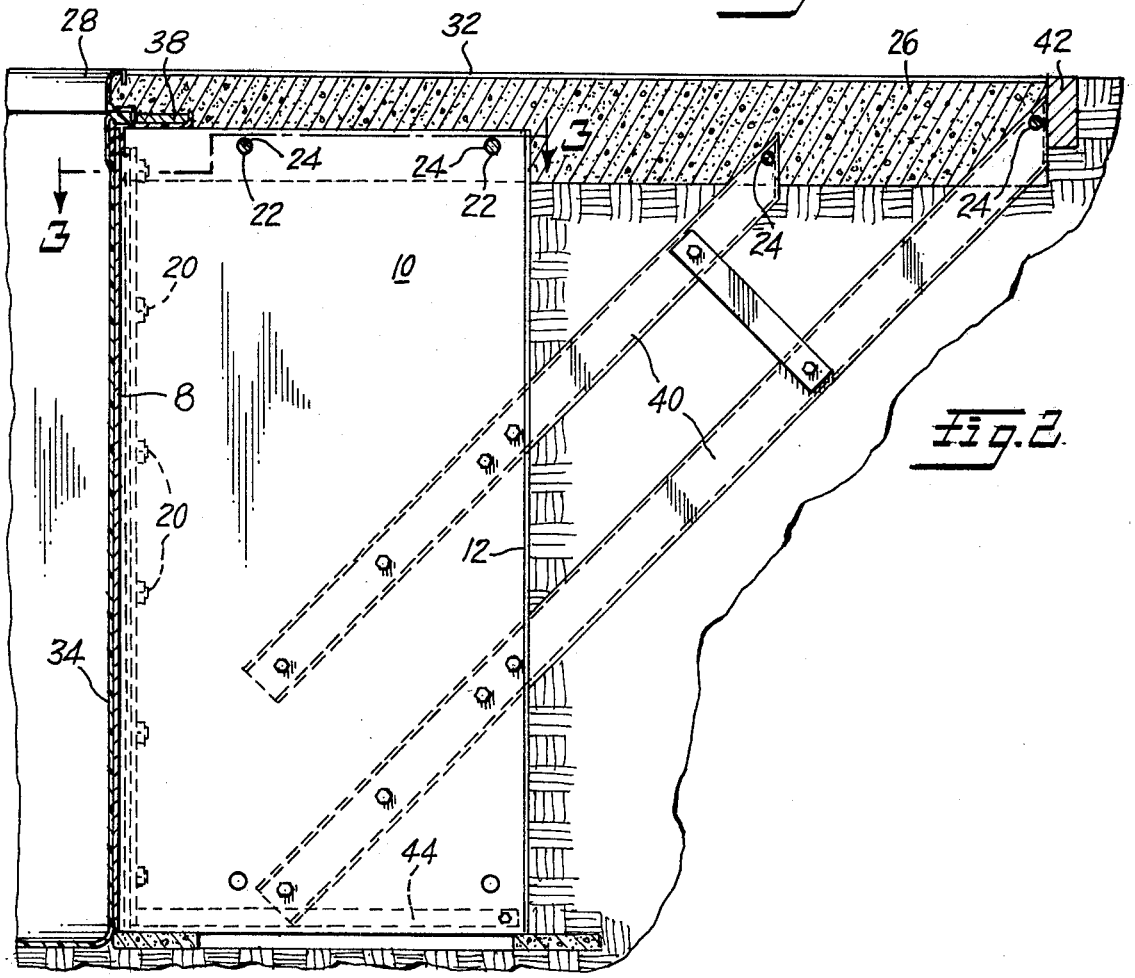
FIG. 2 is an enlarged vertical sectional view taken on the line 2—2 of FIG. 1.
Figure 3:
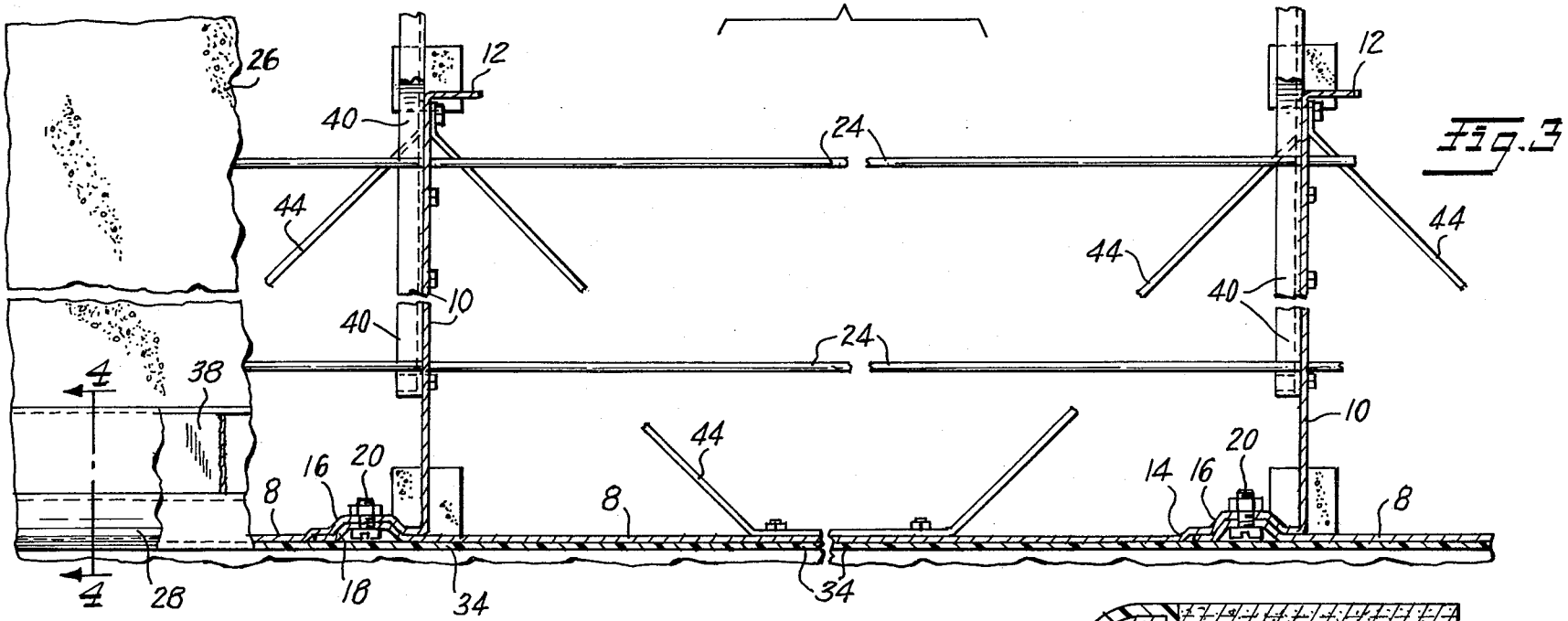
FIG. 3 is an enlarged fragmentary horizontal sectional view, partly in plan, taken substantially on the line 3—3 of FIG. 2, the concrete apron and the earth back-fill are omitted for purposes of clarity.

Referring now to FIGS. 2 and 3, each module of the sidewall comprises a generally planar sheet 8 of metal or other suitable material, one end of which is bent to define a flange 10 extending substantially at right angles to the plate 8. At its outer edge, the flange 10 is provided with a narrow stiffener flange 12, bent to extend in a direction away from the flange 10 opposite the main body of the plate 8 of the module.

Figure 5:
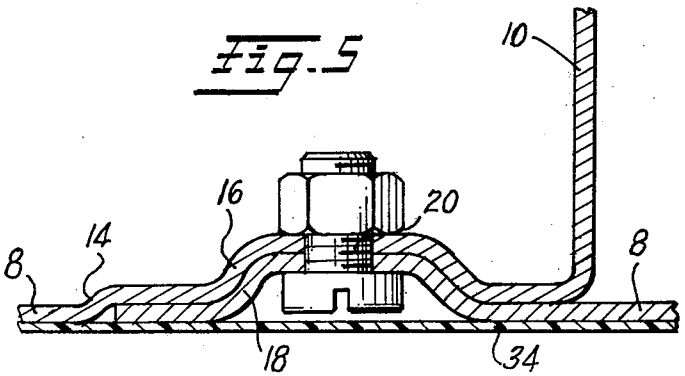
FIG. 5 is an enlarged fragmentary horizontal sectional view through one of the panel joints showing the mating arrangement for assembling the individual panels together.

Adjacent the flange 10, the material of each of the modules is offset to define a step 14 (see FIG. 5), running from top to bottom of the module and a depth substantially equal to the thickness of the plate 8. Thus, when the free edge of one module is placed in the step 14, its inner surface is substantially flush with the inner surface of the adjacent module. In the stepped portion of each module adjacent the flange, and adjacent the opposite edges portions of each module dimples or recesses 16 and 18 are formed, such as by stamping, to define nested recesses when the modules are assembled.

It is to be noted that the dimple or recess of the free edge of the module seats snugly within the recess defined by the inner dimple 16 and thus insures that the modules are properly aligned before headed fasteners 20 are installed to secure the modules together. A series of such recesses is provided with recesses in spaced apart relationship along the step portion of each module, from top to bottom thereof.

It will be obvious from the foregoing that the nested recesses not only serve to align and properly relate adjacent modules, but that they serve also to transmit forces from one module to another without exerting undue strain on the fasteners 20. Sheer stresses in the fasteners could result in failure of the wall.

Adjacent their upper edges, the flanges 10 are provided with openings 22 through which reinforcing rods 24 extend.

In constructing a swimming pool in accordance with the present invention the necessary modules are secured together and placed in the excavation intended for the swimming pool and the flanges 10 thus provide for rigidity of the sidewalls in a vertical direction and also serve to support the reinforcing rods 24. As shown best in FIG. 2, an apron 26 of poured concrete will complete the swimming pool, after suitable footings (not shown) are poured and earth back-fill is in place, and a resilient coping element 28 engages the tops of the modules and particularly the upper edges of sheet metal 8, and is provided with an interlocking flange 30 which is adapted to lock the coping to the concrete apron 26 (FIG. 4) or other apron or deck forming structure. It is to be understood that other forms of coping may be employed and may be mounted in a manner other than that shown.

As best shown in FIG. 2, the upper edge portion of each flange 10 extends upwardly into the concrete of the apron 26, and thus positions the reinforcing rods 24 within the body of the concrete apron. The portions of the flanges 10, extending into the concrete, also define planes of weakenss and the apron 26 is provided with surface grooves 32 as is customary in concrete slabs. Each of the grooves 32 lies in the same plane as an underlying flange 10 and thus define planes of failure where cracking will take place in the event that the concrete slab is, in fact, cracked and thus the cracks will exert no distorting forces on the sidewalls of the pool itself.

Figure 4:
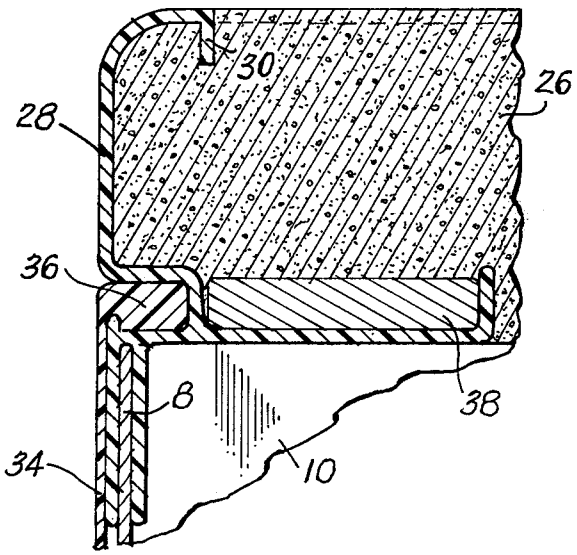
FIG. 4 is an enlarged fragmentary vertical sectional view through the coping of the pool, taken on the line 4—4 of FIG. 3.

As shown in the drawings, a flexible liner 34 will be positioned within the pool to constitute the water retaining portion thereof, the liner having a bead 36 (see FIG. 4) seated in a recess in the coping 28 to be retained thereby. As also shown in FIG. 4, the coping 28 is provided with a stiffening steel bar 38, but which constitutes no part of the present invention.

FIG. 2 also shows diagonal braces 40 secured to the flanges 10 and extending obliquely upwardly and rearwardly into the deck 26. As shown, the upper ends of these braces also support reinforcing rods 24 and the outermost brace 40 is shown as supporting a mold form 42. These braces and the form 42 do not constitute a part of the present invention.

As also shown in FIG. 3, the modules, after assembly, are provided with braces 44 at the bottom edge thereof, but here again the braces 44 constitute no part of the present invention and are merely shown herein to facilitate an understanding of the construction claimed.

While a single specific embodiment of the invention has been shown and described, the same is merely illustrative of the principles involved and other forms may be adopted within the scope of the appended claims.

I claim:

1. In an inground swimming pool wall construction comprised of a plurality of upstanding substantially identical modular units secured together, the improvement comprising:

(a) each modular unit being defined by a sheet of bendable material having an integral vertical flange, at one end thereof, extending substantially perpendicular thereto and outwardly of the pool for imparting rigidity to the wall construction and sustaining vertical compression loading imposed from above, outwardly directed forces imposed by water contained within the pool and inwardly directed forces imposed by surrounding earth;

(b) each modular unit having its opposite end secured to the flanged end of an adjacent unit;

(c) the end portion of each modular unit, adjacent its flange, being offset outwardly by an amount substantially equal to the thickness of the bendable material, with the opposite end of an adjacent unit being seated in the offset;

(d) the offset and the opposite end having mutually nested inwardly open depressions therein;

(e) adjacent modular units being secured together by headed fasteners, the heads of which are seated within the depressions of the innermost of the modular units whereby the nested depressions serve as means for absorbing shear forces developd between the modular units; and (f) the inner faces of the modular units collectively defining a substantially smooth and continuous interior surface.

2. The wall construction of claim 1 wherein each of the flanges, adjacent its upper end, includes at least one opening for receiving a concrete reinforcing bar therethrough.

3. The wall construction of claim 1 wherein each of the flanges, at its outer edge, includes a narrow stiffening flange extending laterally therefrom.

4. In a modular unit for use in constructing the wall of an inground swimming pool, the improvement comprising the modular unit being defined by a sheet of bendable material having an integral vertical flange, at one end thereof, extending substantially perpendicular thereto for imparting rigidity to the modular unit and sustaining vertical compression loading imposed from above, outwardly directed forces imposed by water contained within the pool and inwardly directed forces imposed by surrounding earth, an offset portion disposed adjacent the flange and extending outwardly by an amount substantially equal to the thickness of the material, a first inwardly open depression disposed in the offset, and a second inwardly open depression disposed at the opposite end of the modular unit, the first and second depressions of adjacent modular units being mutually nestable together for absorbing shear forces developed between the modular units.

5. The modular unit of claim 4 wherein the flange, at its outer edge, includes a narrow stiffening flange extending laterally therefrom.

6. The modular unit of claim 4 wherein the flange, adjacent its upper end, includes at least one opening for receiving a concrete reinforcing bar therethrough.

7. An improved wall construction for an inground swimming pool, which wall construction comprises:

(a) a plurality of upstanding substantially identical modular units, with each unit being defined by a sheet of bendable material having an integral vertical flange, at one end thereof, extending substantially perpendicular thereto and outwardly of the pool to provide cantilever bracing for supporting vertical compression loading imposed from above;

(b) each modular unit having its opposite end secured to the flanged end of an adjacent unit;

(c) the end portion of each modular unit, adjacent its flange, being offset outwardly by an amount substantially equal to the thickness of the bendable material and the opposite end of an adjacent unit being seated in the offset;

(d) the offset and the opposite end having mutually nested inwardly open depressions therein;

(e) adjacent modular units being secured together by headed fasteners, the heads of which are seated within the depressions of the innermost of the modular units whereby the nested depressions serve as means for absorbing shear forces developed between the modular units;

(f) the inner faces of the modular units collectively defining a substantially smooth and continuous interior surface for supporting a flexible pool liner; and (g) a pool apron extending outwardly from the top of the modular units, with the upper edge portions of the flanges supporting the vertical compression loading imposed by the apron.

8. The wall construction of claim 7 wherein the pool apron is of concrete and the upper edge portions of the flanges are embedded in the concrete.

9. The wall construction of claim 8 wherein the pool apron includes a plurality of grooves in the upper surface thereof, with the grooves lying substantially in the vertical planes defined by the flanges for permitting controlled cracking of the apron along substantially only the vertical planes.

10. An improved wall construction for an inground swimming pool, which wall construction comprises:

(a) a plurality of upstanding substantially identical modular units, with each unit being defined by a sheet of bendable material having an integral vertical flange, at one end thereof, extending substantially perpendicular thereto and outwardly of the pool to provide cantilever bracing for supporting vertical compression loading imposed from above;

(b) each modular unit having its opposite end secured to the flanged end of an adjacent unit;

(c) the end portion of each modular unit, adjacent its flange, being offset outwardly by an amount substantially equal to the thickness of the bendable material and the opposite end of an adjacent unit being seated in the offset;

(d) the offset and the opposite end having mutually nested inwardly open depressions therein;

(e) adjacent modular units being secured together by headed fasteners, the heads of which are seated within the depressions of the innermost of the modular units whereby the nested depressions serve as means for absorbing shear forces developed between the modular units;

(f) the inner faces of the modular units collectively defining a substantially smooth and continuous interior surface for supporting a flexible pool liner;

(g) each of the flanges, adjacent its upper end, includes at least one opening; and (h) a reinforcing bar extending through the at least one opening of each flange.

* * * * *